United States Patent [19]

Murakami et al.

[11] Patent Number: 4,547,754

[45] Date of Patent: Oct. 15, 1985

[54] FERROMAGNETIC RESONATOR

[75] Inventors: Yoshikazu Murakami, Yokohama; Hiromi Yamada, Chigasaki, both of Japan

[73] Assignee: Sony Corporation, Tokyo, Japan

[21] Appl. No.: 557,953

[22] Filed: Dec. 5, 1983

[30] Foreign Application Priority Data

Dec. 6, 1982 [JP] Japan ..... 57-214426
Dec. 6, 1982 [JP] Japan ..... 57-214427

[51] Int. Cl.[4] ..... H01P 7/08

[52] U.S. Cl. ..... 333/219; 333/24.1; 333/204; 333/228

[58] Field of Search ..... 333/24.1, 24.2, 202, 333/204, 219, 228; 365/171; 331/107 SL, 157

[56] References Cited

U.S. PATENT DOCUMENTS 3,534,276 10/1970 Berteaud et al. ..... 333/242 X
3,766,494 10/1973 Anbe et al. ..... 333/219 X

OTHER PUBLICATIONS

Simpson et al., *Tunable Microwave Filters Using YIG Grown by Liquid Phase Epitaxy,* 4th Microwave Conference, Sep. 10–13, 1974, pp. 590–594.

Cristal et al., *Control of Resonant Frequency of YIG Disk Filter by Doublet Tuning,* IEEE Trans. on MTT, Mar. 1967, pp. 193–195.

*Primary Examiner*—Paul Gensler

*Attorney, Agent, or Firm*—Hill, Van Santen, Steadman & Simpson

[57] ABSTRACT

A ferromagnetic resonator employing a disk of ferrimagnetic material is disclosed. The ferromagnetic resonator comprises a disk of ferrimagnetic material such as yttrium iron garnet (YIG) and a magnet applying D.C. magnetic field perpendicularly to a surface of the disk, and microstrip line applying RF magnetic field to the disk. The disk of ferrimagnetic material is processed to have a groove at a predetermined position on one surface of the disk, or to have a predetermined area in a central portion of the disk with a thickness smaller than that of peripheral portion of the disk, so that spurious response caused by magnetostatic mode other than the uniform mode is suppressed.

8 Claims, 23 Drawing Figures

FERROMAGNETIC RESONATOR

BACKGROUND OF THE INVENTION

1. Field of the Invention

The present invention relates to a ferromagnetic resonator formed of ferromagnetic thin film and suitable for use in microwave devices, and particularly, to a ferromagnetic resonator designed for use in suppressing spurious response.

2. Description of Prior Art

By use of the liquid phase epitaxial growth technology for growing a garnet magnetic film on the gadolinium-gallium garnet (GGG) substrate that has become popular recently through the development of magnetic bubble memory devices, it is possible to make an yttrium-iron garnet (YIG) thin film with satisfactory crystallinity. By forming the YIG thin film into disk or rectangular shape through the selective etching process, and utilizing its ferromagnetic resonance property, microwave devices can be constructed. Application of usual photolithography facilitates the manufacturing process, and yet a high productivity is promised, since a sheet of GGG substrate yields a large number of devices. Moreover, because of it being a thin film material, microwave integrated circuits (MICs) can easily be realized using microstrip lines for transmission lines.

As has been known in the art, microwave devices utilizing ferromagnetic resonance are advantageous in compactness and sharpness of response, and YIG single crystalline spheres have been used in practice to make such microwave devices. The YIG single crystalline sphere is advantageous in that it is hardly excited in magnetostatic modes and a unique resonance mode can be obtained by a uniform precession mode. However, the YIG single crystalline sphere has shortcomings in manufacturing and productivity, and therefore, formation of ferromagnetic resonator using the YIG thin film has been desired.

The YIG thin film has had a problem of being apt to excite in many magnetostatic modes even if it is placed in a uniform RF magnetic field, due to its nonuniform internal DC magnetic field. Magnetostatic modes of a disk-shaped ferrimagnetic specimen with a DC magnetic field applied perpendicularly to the specimen surface is analyzed in an article in Journal of Applied Physics, Vol. 48, July 1977, pp. 3001–3007. Each mode is expressed by $(n,N)_m$, i.e., the node has n modes in the circumferential direction, N nodes in the radial direction, and m−1 nodes in the thickness direction. When the high-frequency magnetic field is applied uniformly to the whole area of specimen, the $(1,N)_1$ series becomes the major magnetostatic mode. FIG. 1 shows, the measured result of ferromagnetic resonance in a disk shaped thin film specimen measured in the 9 GHz cavity, indicating the excitation in many magnetostatic modes of $(1,N)_1$ series. When this specimen is used to form a microwave device such as a band-pass filter, its major resonance mode, i.e., mode $(1,1)_1$ is used, and in this case all other magnetostatic modes cause spurious response.

SUMMARY OF THE INVENTION

It is an object of the present invention to provide a ferromagnetic resonator using ferrimagnetic thin film.

Another object of the invention is to provide a ferromagnetic resonator using ferrimagnetic thin film and capable of suppressing spurious response.

Still another object of the invention is to provide a thin film ferromagnetic resonator capable of being readily formed into a microwave integrated circuit.

Still another object of the invention is to provide a ferromagnetic resonator using ferrimagnetic thin film and operable to suppress excitation in magnetostatic modes causing spurious response without impairing the major resonance mode.

According to one aspect of the present invention, there is provided a ferromagnetic resonator comprising a ferrimagnetic layer, means for applying a DC magnetic field perpendicularly to the layer, and means for applying an RF magnetic field to the layer so as to cause ferromagnetic resonance, the ferrimagnetic layer being processed so that spurious response caused by magnetostatic modes other than the uniform mode is suppressed.

According to another aspect of the invention, there is provided a ferromagnetic resonator as mentioned above, wherein the ferrimagnetic layer is processed to have a groove at a predetermined position on one surface of the layer so that spurious response caused by magnetostatic modes other than the uniform mode is suppressed.

According to still another aspect of the invention, there is provided a ferrimagnetic resonator as mentioned above, wherein the ferrimagnetic layer is processed to have a predetermined area in a central portion thereof with a thickness smaller than that of peripheral portions of the layer so that the internal D.C. magnetic field in the thinner area is made uniform.

DESCRIPTION OF THE PREFERRED EMBODIMENT

Figure 1:
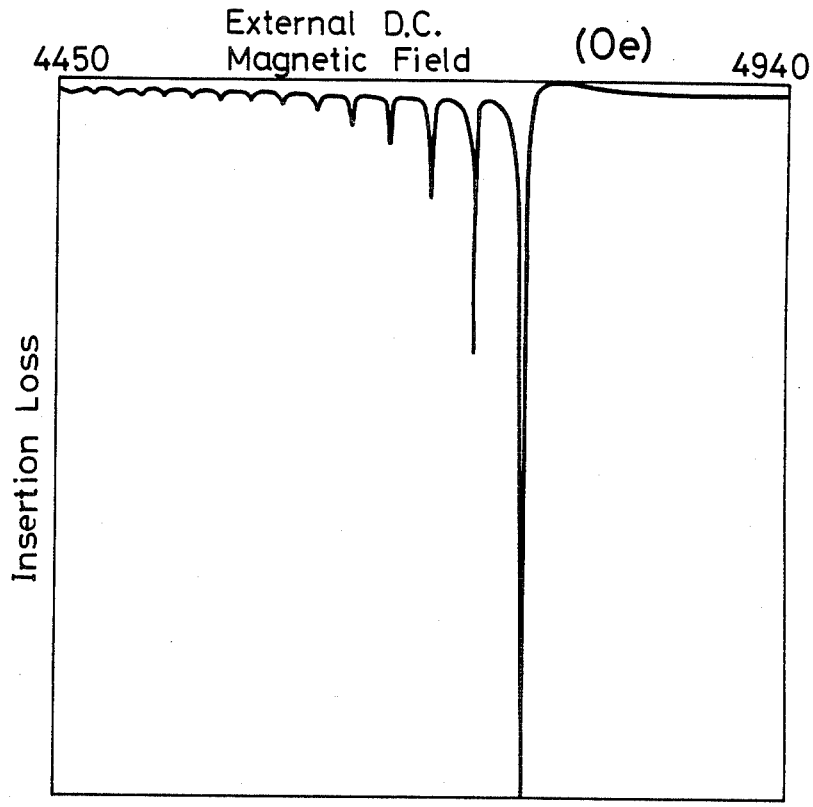
FIG. 1 is a graph showing the occurrence of magnetostatic modes in the conventional disk shaped ferrimagnetic thin film.
Figure 2:
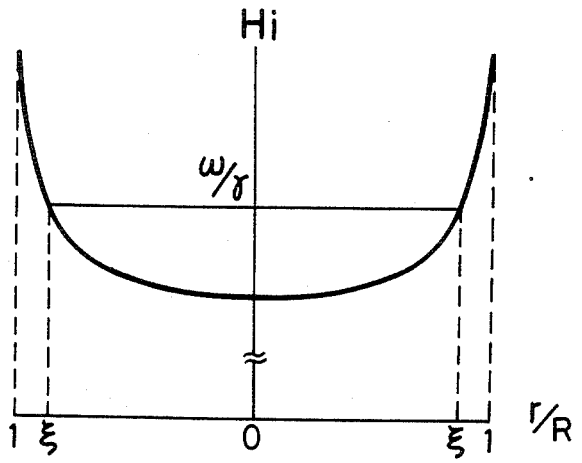
FIG. 2 is a graph showing the distribution of internal DC magnetic field in the disk shaped ferrimagnetic thin film.
Figure 3A:
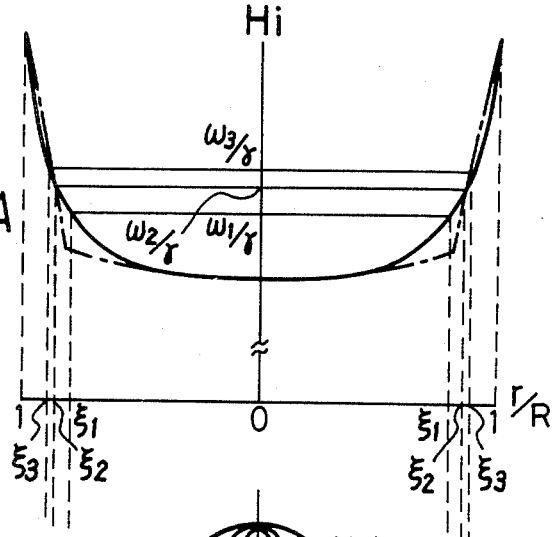
FIGS. 3A and 3B are graphs showing the relation between the distribution of internal DC magnetic field and the distribution of RF magnetization in the magnetostatic modes for the disk shaped ferrimagnetic thin film.
Figure 3B:
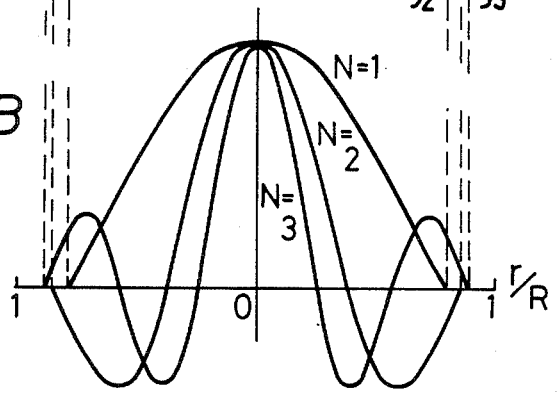

The inventors of the present invention have pursued studies in order to achieve the foregoing objectives, and became to pay attention to the fact that the RF magnetization components distribute in the specimen differently depending on the magnetostatic mode. This affair will first be discussed in connection with FIGS. 2 and 3. FIG. 2 shows the distribution of internal DC magnetic field Hi when the DC magnetic field is applied perpendicularly to the surface of a YIG disk with a thickness of t and diameter of D (or radius of R). Here, the aspect ratio t/D of the specimen is assumed to be small enough, so that the distribution of magnetic field in the thickness direction can be ignored. Since the demagnetizing field is large in the inner portion of the disk and falls sharply as the measuring point moves toward the periphery, the internal DC magnetic field is small in the central section and increases sharply at the peripheral section. According to the analysis of the above-mentioned publication, magnetostatic modes reside in a region of $0 \leqq r/R \leqq \xi$, where $\xi$ is the value of r/R at the position of $Hi = \omega/\gamma$, $\omega$ is the resonant angular frequency in magnetostatic modes and $\gamma$ is gyromagnetic ratio. Under the fixed magnetic field, the resonance frequency increases as the mode number N increases, and the magnetostatic mode region expands outward as shown in FIG. 3A. FIG. 3B shows the distribution of RF magnetization in the specimen in low-order three modes of $(1,N)_1$, where the absolute value indicates the relative magnitude of RF magnetization where the polarity indicates the phase relation of RF magnetization and each of the magnitudes is normalized at the center. As can be seen from FIGS. 3A and 3B, RF magnetization components have different forms depending on the magnetostatic mode, and by utilizing this property, excitation in magnetostatic modes causing spurious response can be suppressed without a significant effect on the major resonance mode.

The inventors also have become to pay attention to the fact that the internal DC magnetic field becomes substantially constant across a wide range when the inner area of the ferrimagnetic thin film is made thinner than the outer area.

Figure 4A:
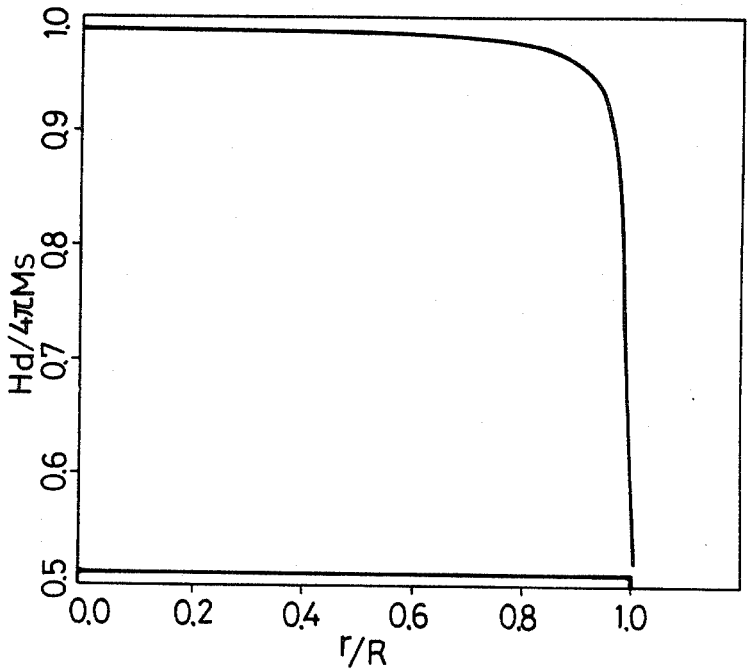
FIGS. 4A and 4B are graphs showing the distribution of demagnetizing field in the disk shaped ferrimagnetic thin film.
Figure 4B:
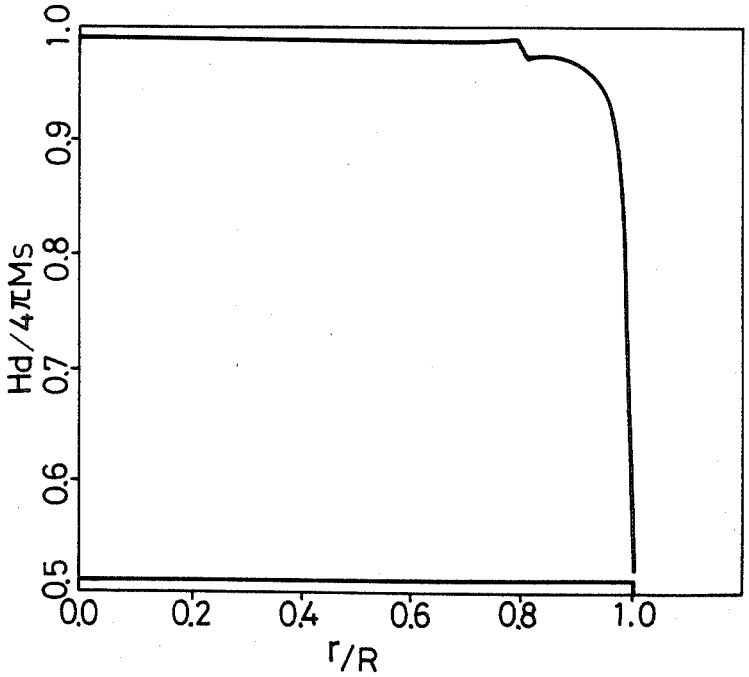

This affair will be discussed in connection with FIGS. 4A and 4B. The internal DC magnetic field Hi when the DC magnetic field Ho is applied perpendicularly to the major plane of a YIG disk with a thickness of t and diameter of D (or radius of R) will be $Hi = Ho - Hd(r/R) - Ha$, where Hd is the demagnetizing field and Ha is the anisotropic magnetic field. Here, the aspect ratio t/D is assumed to be small enough, so that the distribution of magnetic field in the thickness direction of the specimen can be ignored. FIG. 4A is a plot, based on calculation of the demagnetizing field Hd for a YIG disk with a thickness of 20 $\mu$m and radius of 1 mm.

The demagnetizing field is large in the inner section and falls sharply at the peripheral section, and in consequence, the internal DC magnetic field is small in the center and rises sharply at the peripheral section. FIG. 4B is a plot of the distribution of demagnetizing field based on the calculation for the YIG disk with a thickness of 20 $\mu$m and radius of 1 mm, but made thinner by 1 $\mu$m for the inner area within 0.8 mm in radius. The plot indicates that by making the inner section of film a bit thinner, the demagnetizing field in the portion immediately outside the thinner portion is lifted, so that the flat region of demagnetizing field expands outward.

Accordingly, the present invention contemplates to suppress only excitation in magnetostatic modes causing spurious response as mentioned above through the physical treatment for the shape of the ferrimagnetic thin film. Namely, according to this invention, a groove is formed in a certain position of the ferrimagnetic thin film so that the magnetostatic modes other than the major mode causing spurious response are suppressed, or alternatively, a certain extent of inner area of the ferrimagnetic thin film is made thinner than the remaining outer area so as to expand the flat region of internal magnetic field, thereby suppressing the magnetostatic modes causing spurious response.

Figure 5:
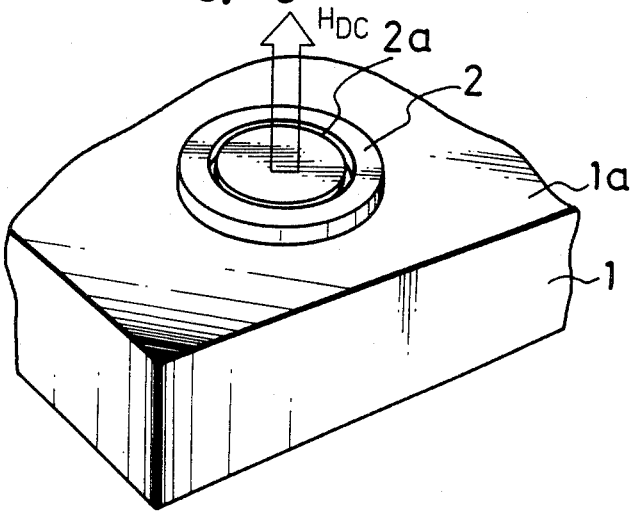
FIG. 5 is a perspective view of the ferrimagnetic thin film used in the ferromagnetic resonator embodying the present invention.

The invention will now be described in detail. On a major surface 1*a* of a substrate 1, there is formed a ferrimagnetic layer 2 in a certain shape as shown in FIG. 5. An annular groove 2*a* is formed in the ferrimagnetic layer 2. A magnetic field (not shown) is applied perpendicularly to the substrate 1.

The substrate 1 may be, for example, of a GGG material, and, in this case, a YIG thin film is formed by liquid phase epitaxial growth, and thereafter, the ferrimagnetic layer 2 is formed by the photolithographic technology. The ferrimagnetic layer 2 may of course be formed by processing a bulk material. Possible shapes of the ferrimagnetic layer 2 are disk, square, rectangle, etc. The ferrimagnetic layer 2 is made thin enough (small aspect ratio) so that the magnetic field distributes uniformly in the thickness direction of the layer 2. In this case, the exciting magnetostatic mode is $(1,N)_1$.

The groove 2*a* is formed concentrically in a certain distance from the center so that RF magnetization in mode $(1,1)_1$ is nullified. The groove 2*a* may either be continuous or interruptive.

In such a ferromagnetic resonator, magnetization is determined by the presence of the groove 2*a*. Since the groove 2*a* is located at the position where RF magnetization is nullified for mode $(1,1)_1$, excitation in mode $(1,1)_1$ is not affected. On the other hand, the groove 2*a* is located at a position where RF magnetization for other magnetostatic modes are not zero, and therefore, excitation in these modes is weakened. Consequently, spurious response can be suppressed without impairing the major resonance mode.

The distribution of RF magnetization in the ferrimagnetic layer 2 (see FIG. 3B) is entirely independent of the magnitude of the saturation magnetization of the specimen, and does not largely depend on the aspect ratio. Accordingly, this invention is advantageous in that the position of the groove 2*a* does not need to change depending on the possible variation in the saturation magnetization or thickness of the ferrimagnetic layer 2, and this is practically beneficial in the lithographic process.

Figure 6:
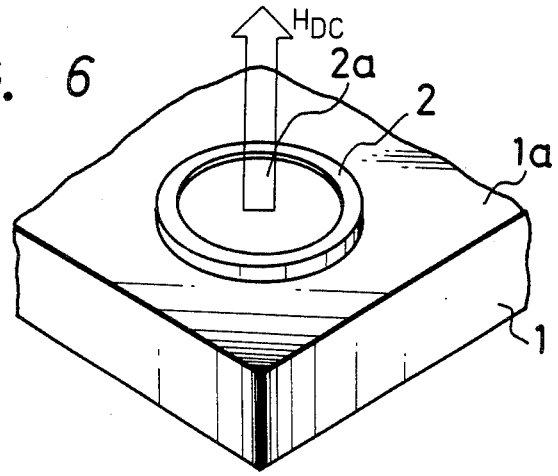
FIG. 6 is a perspective view of the ferrimagnetic thin film used in another embodiment of the ferromagnetic resonator of the present invention.

An alternative formation of the inventive ferromagnetic resonator is as follows. On a major surface 1*a* of a substrate 1, there is formed a ferrimagnetic layer 2 in a certain shape as shown in FIG. 6. A recess 2*a* is formed in the upper surface of the layer 2 so that the inner area becomes thinner than the outer area. A magnetic field (not shown) is applied perpendicularly to the substrate 1.

The substrate 1 may be, for example, of a GGG material, and, in this case, a YIG thin film is formed by liquid phase epitaxial growth, and thereafter, the ferrimagnetic layer 2 is formed by the photolithographic technology. The ferrimagnetic layer 2 may of course by formed by processing a bulk material. Possible shapes of the ferrimagnetic layer 2 are disk, square, rectangle, etc. The layer 2 is made thin enough (small aspect ratio) so that the magnetic field distributes uniformly in the thickness direction of the layer 2. In this case, the magnetostatic mode is $(1,N)_1$.

The recess 2*a* is extended to the position so that excitation of magnetostatic modes causing spurious response can be supressed sufficiently. Preferably, the recess 2 is extended to the position at which the amplitude of mode $(1,1)_1$ is nullified, e.g., to the distance 0.75–0.85 time the diameter of the layer 2 when it is a disk.

Such a ferromagnetic resonator provides a substantially uniform demagnetization across the entire area of the recess 2*a*, as has been mentioned previously in connection with FIG. 4B. In consequence, the internal DC magnetic field can be made uniform in a wide range, whereby magnetostatic modes causing spurious response can be suppressed.

Figure 7:
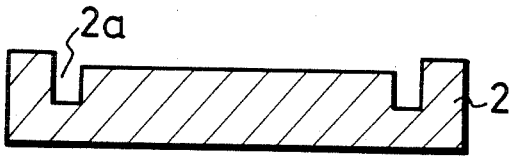
FIG. 7 is a cross-sectional view of the ferromagnetic thin film used in still another embodiment of the ferromagnetic resonator of the present invention.

The area enclosed by the groove 2*a* may be made thinner than the outer area as shown in FIG. 7. In this case, demagnetization is lifted at the inner portion in proximity to the groove 2*a*, and a substantially uniform demagnetization is obtained up to this range. In other words, the internal DC magnetic field becomes substantially constant in a wide range along the radial direction as shown by the dot-and-dash line in FIG. 3A. This allows further effective suppression against excitation in magnetostatic modes other than the major resonance mode.

Figure 11A:
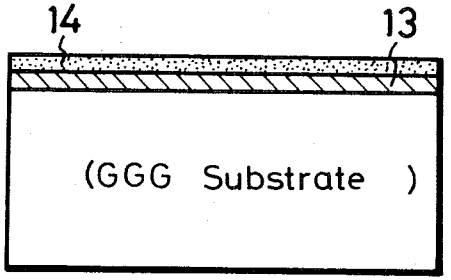
Figure 11B:
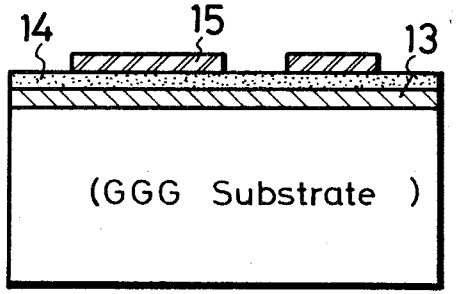
Figure 11C:
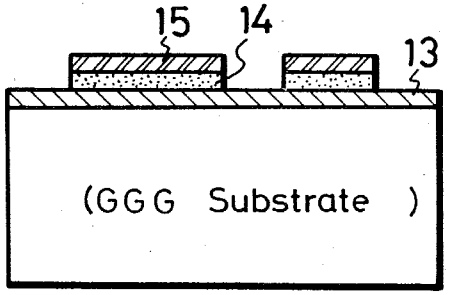
Figure 11D:
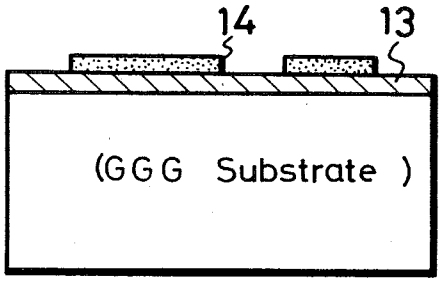
Figure 11E:
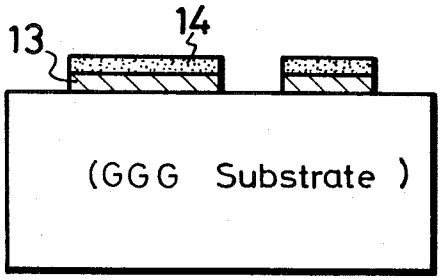
Figure 11F:
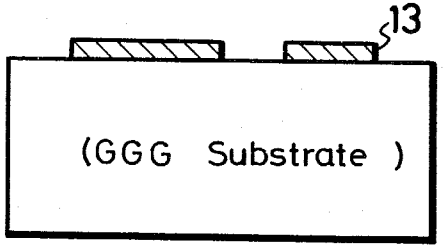

In the above-mentioned photolithographic process, polyimide can be used for the protection film. Namely, as shown in FIG. 11A, a polyimide precursor is applied over the material to be processed (garnet thin film and substrate) 13 and, thereafter, hardened by heating to form a polyimide film 14. Then, a photoresist pattern 15 is formed on the polyimide film 14 (FIG. 11B) and, thereafter, the polyimide film 14 is etched off using the polyimide etchant, e.g., hydrazine hydrate, to form a pattern of polyimide film 14 (FIG. 11C). After that, the photoresist 15 is removed (FIG. 11D). Etching is carried out in the heated phosphoric acid (FIG. 11E). The etching speed is, for example, about 0.5 μm/min in phosphoric acid at 160° C., or about 1 μm/min in phosphoric acid at 180° C. Finally, the polyimide film 14 is removed using the polyimide etchant (FIG. 11F).

Figure 12:
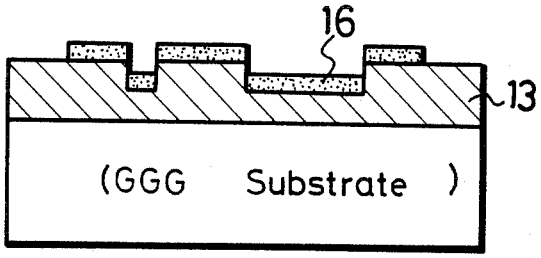
FIGS. 11A to 11F, 12 and 13 are illustrations used to explain the method of fabricating the ferromagnetic resonator of the present invention.

Conventionally, the $SiO_2$ film formed by CVD method or sputtering method have been used as a protection film for chemical etching for the garnet thin film or garnet substrate. However, this has needed a large facility for coating the $SiO_2$ film, and the occurrence of cracks and pinholes has also been a problem. In addition, it has been difficult to make a coating of $SiO_2$ film 16 over the entire surface as shown in FIG. 12 when the surface is offset for the purpose of recess 2*a* as in the inventive structure (see FIG. 6).

Figure 13:
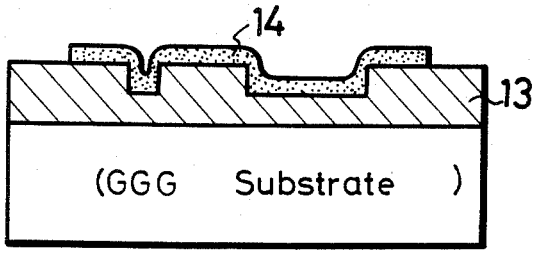

The polyimide protection film allows the use of small facility, and the occurrence of pinholes and cracks can mostly be avoided. The flow ability of polyimide precursor ensure the coating of polyimide protection film to the offset portions, as shown in FIG. 13.

In order to further enhance the heat resistivity of the protection film, polyimide resin having the isoindroquinazolinedione structure is included. Moreover, a polyimide film formed of the photosensitive polyimide precursor which is a copolymer of photosensitive polymer and polyimide precursor is included. In this case, the polyimide pattern can be formed in the similar process to that of the usual photoresist, and the foregoing steps of forming a resist pattern and etching the polyimide film for making the polyimide pattern are eliminated, whereby the fabricating process can be simplified considerably.

For the etching process, reactive sputtering or ion milling may be employed in addition to the foregoing chemical etching, but at a cost of larger facility.

The invention will be described in more detail by way of embodiment.

Embodiment 1

Figure 8:
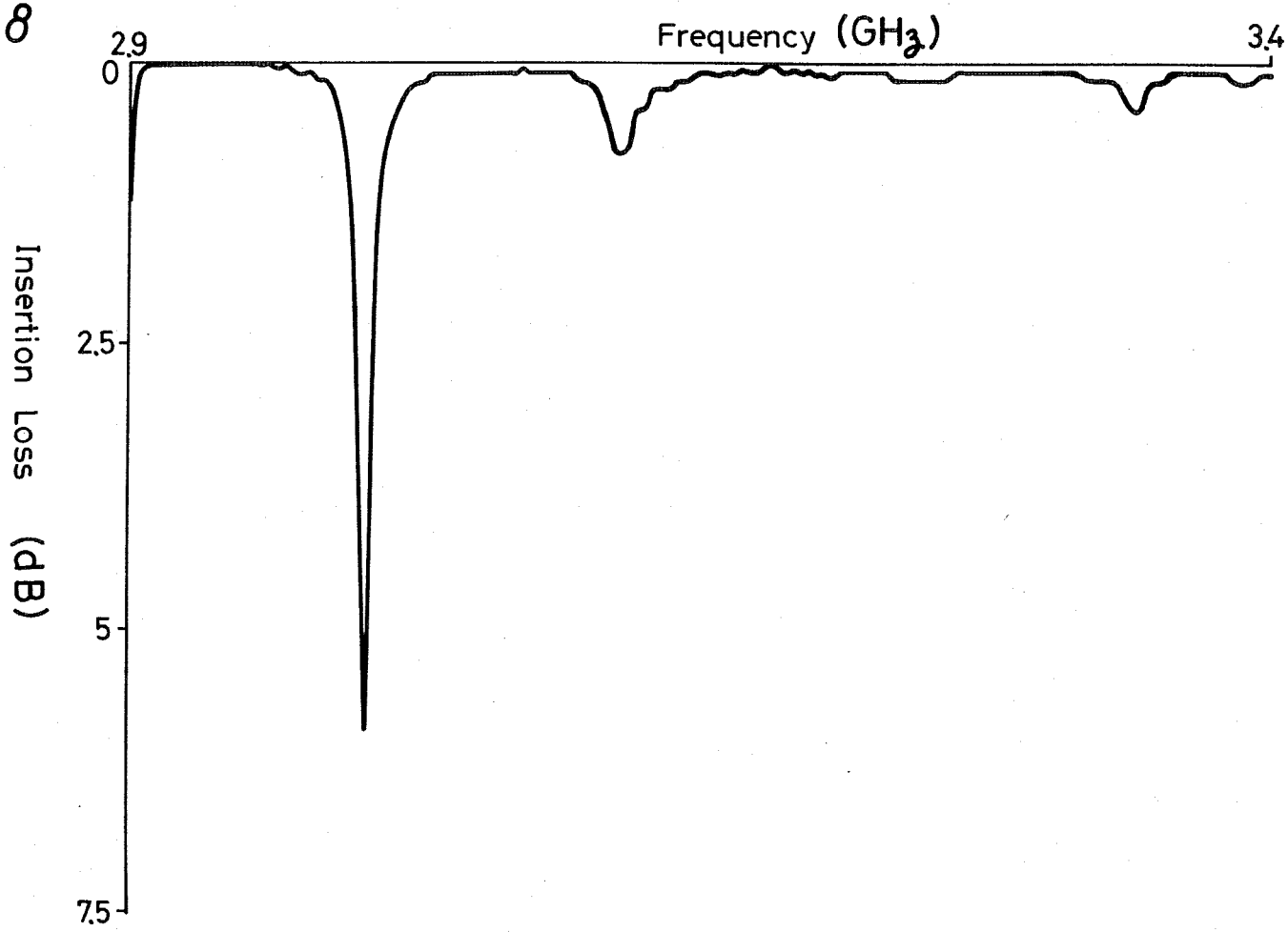
FIGS. 8 and 9 are graphs showing the measured result of insertion loss in the ferromagnetic resonators of the present invention.

A YIG disk with a thickness of 20 μm and radius of 1 mm cut out from a YIG thin film was processed to form an annular groove wih a depth of 2 μm and width of 10 μm at a distance of 0.8 mm from the disk center, and the ferromagnetic resonance was measured by introducing an electromagnetic wave using microstrip lines, while the external magnetic field being applied perpendicularly to the disk surface. FIG. 8 shows the measured result of insertion loss. The value of unloaded Q was 775. Note: RF magnetization of mode $(1,1)_1$ falls to zero at the position of $r/R=0.8$ on the YIG disk.

Embodiment 2

Figure 9:
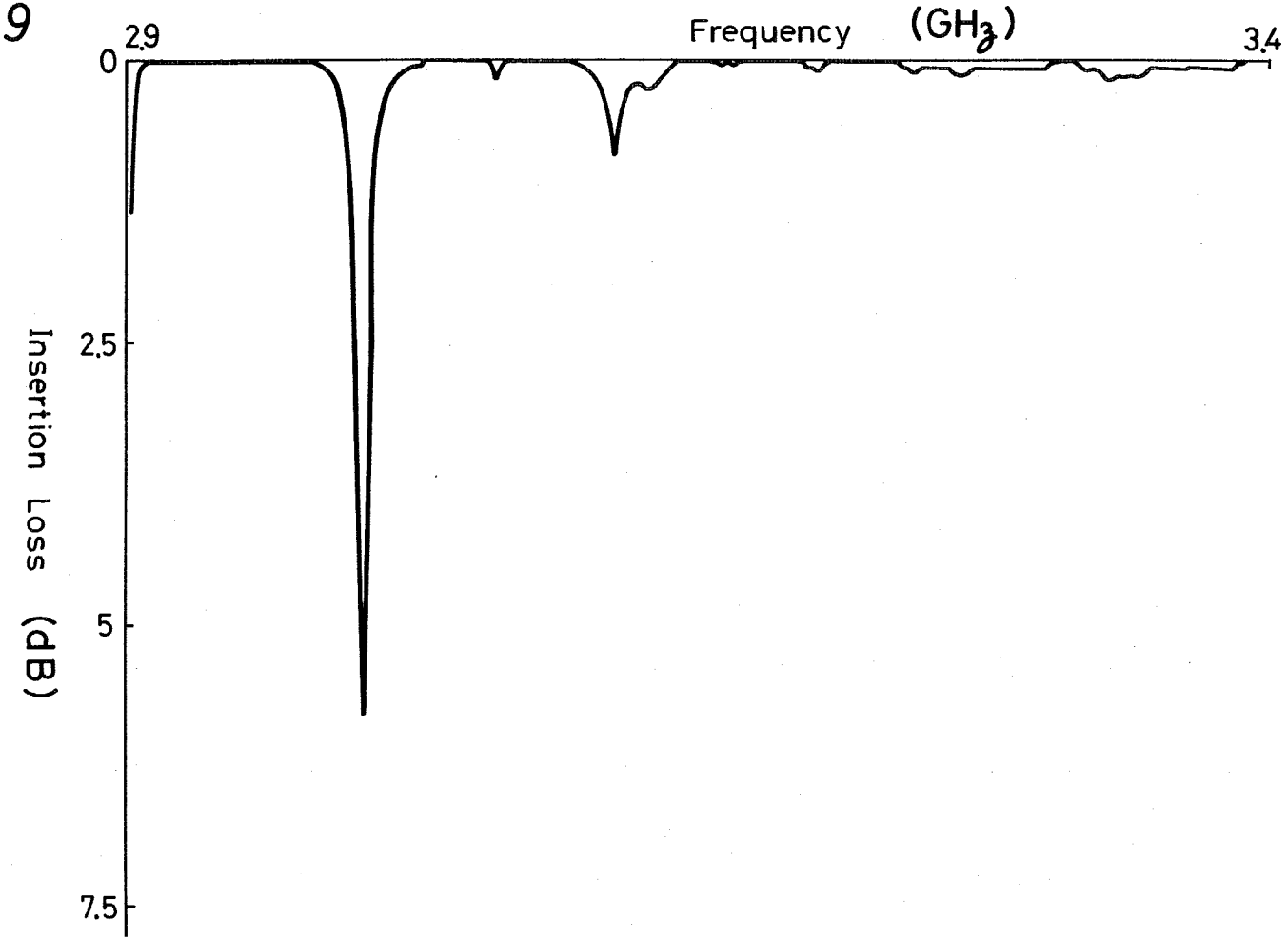

A YIG disk with a thickness of 20 μm and radius of 1 mm cut out from a YIG thin film was processed to form a circular recess with a depth of 1.7 μm and radius of 0.75 mm concentrically on the disk, and the ferromagnetic resonance was measured using microstrip lines. FIG. 9 shows the measurement result of insertion loss. The value of unloaded Q was 865.

Comparison Sample

Figure 10:
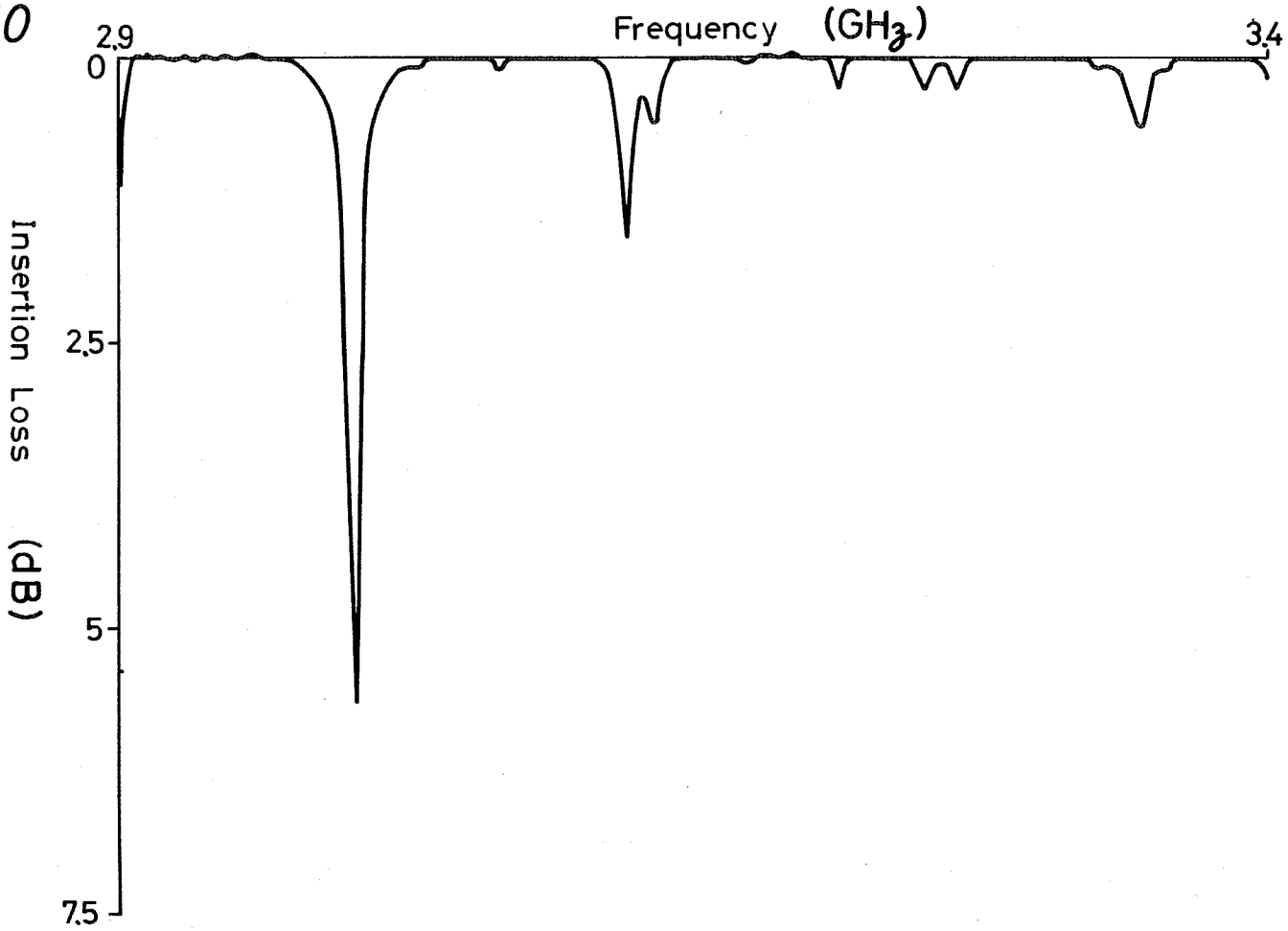
FIG. 10 is a graph showing an example of insertion loss useful to compare with the measured result shown in FIGS. 8 and 9.

A YIG disk with a thickness of 20 μm and radius of 1 mm cut out from the same YIG thin film as used in the foregoing embodiments was prepared, but without making any groove nor recess in this case, and the ferromagnetic resonance was measured using microstrip lines. FIG. 10 shows the measurement result of insertion loss. The value of unloaded Q was 660.

As will be appreciated by comparing the embodiments with the comparison sample, the inventive structure is effective in suppressing excitation of magnetostatic modes other than mode $(1,1)_1$, whereby spurious response can be suppressed. In addition, the major resonance mode is not sacrificed, and thus the unloaded Q is not impaired.

Figure 14A:
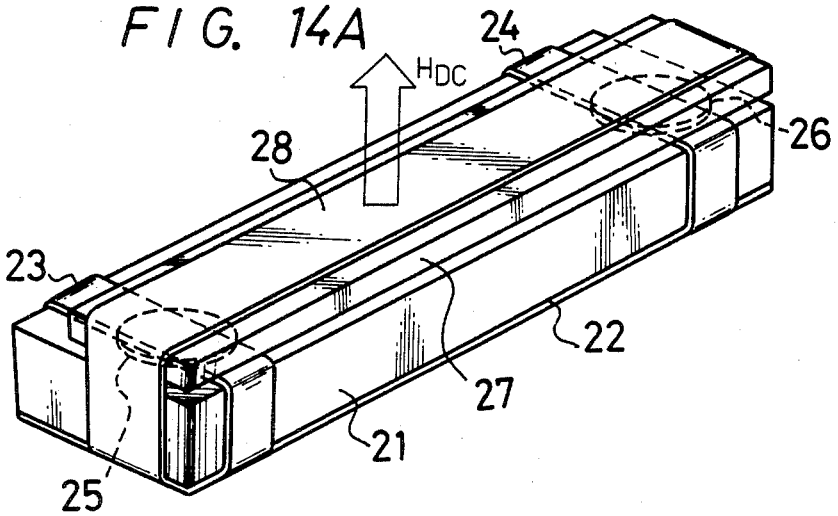
FIGS. 14A to 14C are diagrams showing the filter device constructed by application of the ferromagnetic resonator of the present invention.
Figure 14B:
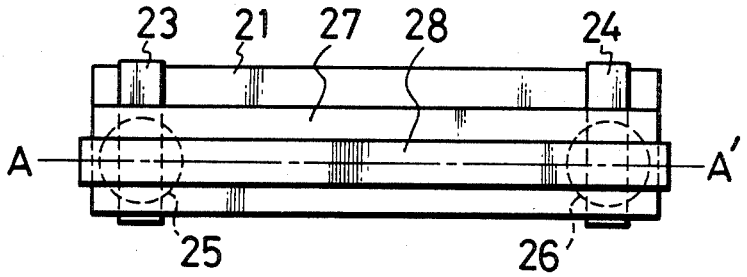
Figure 14C:
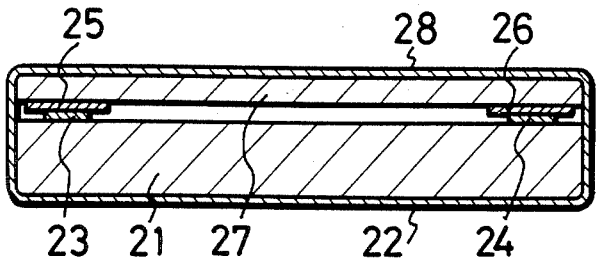

The inventive ferromagnetic resonator can be applied to band-pass filters and band-stop filters. As an example, FIGS. 14A to 14C show a MIC band-pass filter made from YIG thin film. FIG. 14A is a perspective view of the device, FIG. 14B is a plan view, and FIG. 14C is a cross-sectional view taken along the line A–A' of FIG. 14B. Reference number 21 denotes an alumina substrate, on the rear surface of which is formed a ground conductor 22, while the remaining surface being provided with a formation of input and output transmission lines (microstrip lines) 23 and 24 aligned in parallel to each other. Each end of the transmission lines 23 and 24 is connected to the ground conductor 22.

On the top surface of the alumina substrate 21, there is placed a GGG substrate 27 having two circular YIG thin films 25 and 26. The GGG substrate 27 is provided thereon with a formation of an interconnection line (microstrip line) for linking the YIG thin films 25 and 26 disposed to intersect the input and output transmission lines 23 and 24, with both ends of the line 28 being connected to the ground conductor 22. The first YIG thin film 25 is placed at the position where the input transmission line 23 and interconnection line 28 intersect, and the second YIG thin film 26 is placed at the position where the output transmission line 24 and interconnection line 28 intersect. The distance between the two YIG thin films 25 and 26 is set equal to a quarter of wavelength ($\lambda/4$) of the center frequency of the transmission band so that the insertion loss increases sharply outside the transmission band.

Although not shown in the figures, the first and second YIG thin films are provided with yokes of permanent magnet which apply the external DC magnetic field perpendicularly to their major surfaces.

We claim:

1. A ferromagnetic resonator comprising:

a layer of ferrimagnetic material;

means for applying a DC magnetic field perpendicularly to said ferrimagnetic layer;

means for applying an RF magnetic field to said ferrimagnetic layer so as to cause ferromagnetic resonance; said ferrimagnetic layer being processed, during fabrication, to have a groove at a predetermined position on one surface of said layer so that spurious response caused by magnetostatic modes other than a uniform mode is suppressed.

2. A ferromagnetic resonator comprising:

a layer of ferrimagnetic material;

means for applying a DC magnetic field perpendicularly to said ferrimagnetic layer;

means for applying an RF magnetic field to said ferrimagnetic layer so as to cause ferromagnetic resonance; said ferrimagnetic layer being processed, during fabrication, to have a predetermined area in a central portion thereof with a thickness smaller than the thickness of peripheral portions of said layer so that the internal D.C. magnetic field in said thinner area is made uniform.

3. A ferromagnetic resonator according to claim 1, wherein said groove is formed about a position at which RF magnetization of the uniform mode is nullified.

4. A ferromagnetic resonator according to claim 2, wherein said thinner area of said ferrimagnetic layer is an area in which RF magnetization of the uniform mode is nullified.

5. A ferromagnetic resonator according to any one of claims, 1 and 2, wherein said means for applying an RF magnetic field comprises a microstrip line coupled to said ferrimagnetic layer.

6. A ferromagnetic resonator according to any one of claims 1 and 2, wherein said means for applying a DC magnetic field comprises a permanent magnet.

7. A ferromagnetic resonator according to any one of claims 1 and 2, wherein said ferrimagnetic layer is formed on a non-magnetic substance.

8. A ferromagnetic resonator according to claim 7, wherein said ferrimagnetic layer comprises an film grown epitaxially on a GGG substrate.

* * * * *